US008689591B2

(12) United States Patent
Elsner et al.

(10) Patent No.: US 8,689,591 B2
(45) Date of Patent: Apr. 8, 2014

(54) PERSONAL PROPERTY SAFE

(75) Inventors: Sean M. Elsner, Olathe, KS (US); Rob Gilliom, Wooster, AR (US)

(73) Assignee: 9G Products, Inc., Bonner Springs, KS (US)

( * ) Notice: Subject to any disclaimer, the term of this patent is extended or adjusted under 35 U.S.C. 154(b) by 15 days.

(21) Appl. No.: 12/977,305

(22) Filed: Dec. 23, 2010

(65) Prior Publication Data

US 2011/0146359 A1 Jun. 23, 2011

Related U.S. Application Data

(60) Provisional application No. 61/284,672, filed on Dec. 23, 2009.

(51) Int. Cl.
*E05B 65/52* (2006.01)

(52) U.S. Cl.
USPC ..... 70/63; 70/278.7; 70/279.1; 211/64; 206/317; 292/201; 292/216

(58) Field of Classification Search
USPC ..... 70/63, 58, 277, 278.7, 278.3, 279.1, 70/283.1, 416; 42/70.11; 211/64; 206/317; 224/912, 913; 292/201, 216, DIG. 22; 248/551–553
See application file for complete search history.

(56) References Cited

U.S. PATENT DOCUMENTS

| | | | | | |
|---|---|---|---|---|---|
| 3,504,511 | A * | 4/1970 | Allen | 70/241 |
| 3,917,330 | A * | 11/1975 | Quantz | 292/216 |
| 4,667,990 | A * | 5/1987 | Quantz | 292/201 |
| 4,768,021 | A | 8/1988 | Ferraro | |
| 5,020,838 | A * | 6/1991 | Fukumoto | 292/201 |
| 5,238,274 | A * | 8/1993 | Becker et al. | 292/201 |
| 5,701,770 | A | 12/1997 | Cook et al. | |
| 5,901,991 | A * | 5/1999 | Hugel et al. | 292/201 |
| 6,260,300 | B1 | 7/2001 | Klebes et al. | |
| 6,811,193 | B2 * | 11/2004 | Arabia et al. | 292/216 |
| 7,178,370 | B2 | 2/2007 | Engel | |
| 7,236,085 | B1 * | 6/2007 | Aronson et al. | 340/5.64 |
| 7,826,220 | B1 | 11/2010 | Baker | |
| 8,104,313 | B2 * | 1/2012 | Wolfe | 70/63 |
| 2005/0087994 | A1 * | 4/2005 | Umino | 292/216 |
| 2006/0237974 | A1 * | 10/2006 | Hamm et al. | 292/216 |
| 2007/0132551 | A1 * | 6/2007 | Mozer et al. | 340/5.52 |
| 2010/0072761 | A1 * | 3/2010 | Tomaszewski et al. | 292/201 |

* cited by examiner

*Primary Examiner* — Lloyd Gall
(74) *Attorney, Agent, or Firm* — Erickson Kernell Derusseau & Kleypas, LLC

(57) ABSTRACT

A safe is provided for securely storing property that may be accessed quickly. A biometric scanner is coupled to a latching mechanism which may be actuated upon input of a recognized pattern, such as a fingerprint. The safe door may be spring actuated to automatically open upon release of the locking mechanism. The latch positively locks the door so that it resists opening from sharp blows to the safe.

9 Claims, 7 Drawing Sheets

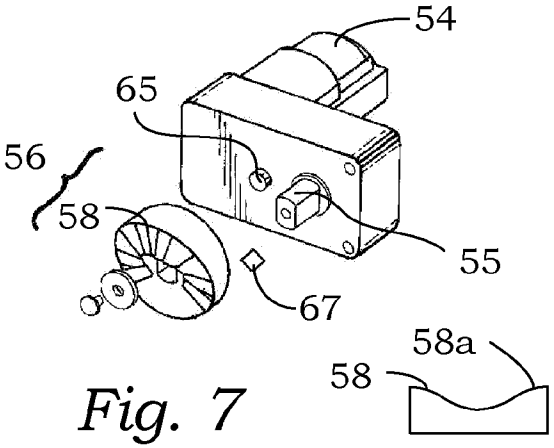
Fig. 7
Fig. 7a
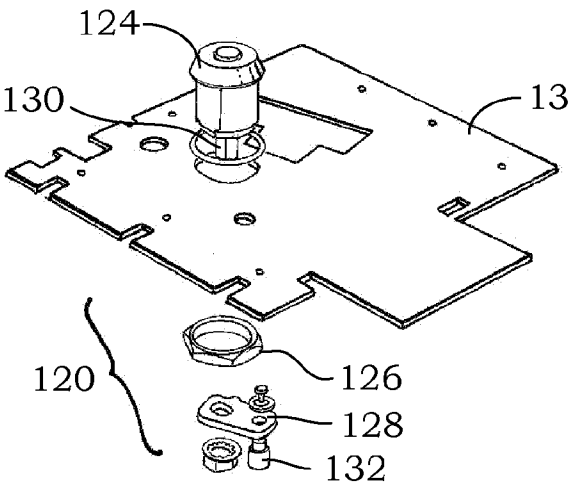
Fig. 8
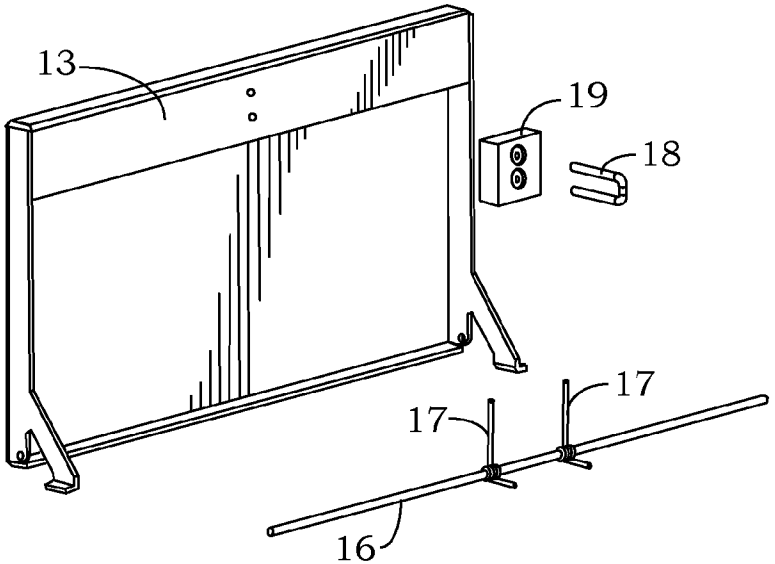
Fig. 2

PERSONAL PROPERTY SAFE

CROSS-REFERENCE TO RELATED APPLICATION

This application claims the benefit of, application Ser. No. 61/284,672, filed on Dec. 23, 2009, entitled INPRINT PERSONAL PROPERTY SAFE WITH BIOMETRIC SAFE LOCKING TECHNOLOGY.

FIELD

The present invention relates to a locking storage safe and, more particularly, to a locking storage safe that utilizes biometric data to provide access to the contents of the safe.

BACKGROUND

Lock boxes and safes for storage of personal property are known in the art. A variety of methods have been used to secure the contents such as pad locks, built in locks and combination locks, for example. One problem with these locking devices is the time needed to unlock the safe. With a key lock, the key must be located, placed in the lock then turned. Often the key is left in the lock so that it won't be misplaced thereby defeating the purpose of the lock and safe.

A problem with a combination lock is the combination of three or more numbers must be memorized or stored in a readily accessible location for reference. In times of stress, numbers are often forgotten. If the combination is misplaced, it is difficult to gain access to the contents of the safe. Further, a combination lock cannot be opened quickly, if necessary. To open the safe requires one or both hands to manipulate the locking mechanism, actuate the latch and open the door to the safe.

Additionally, if it is dark, a key may be difficult to locate, the keyhole may be difficult to locate, and a combination may be difficult to enter. The problem is particularly critical if the access to the safe is needed for personal safety, such as gaining access to a hand gun or other protective device in an emergency situation.

SUMMARY

The present invention provides an apparatus for securely storing property that may be accessed quickly. A biometric scanner is coupled to a locking mechanism which may be actuated upon input of a recognized pattern, such as a fingerprint. The safe door may be spring actuated to automatically open upon release of the locking mechanism. The latch positively locks the door so that it resists opening from sharp blows to the safe.

BRIEF DESCRIPTION OF THE DRAWINGS

FIG. 2 is an exploded perspective view of the door assembly of the personal property safe of FIG. 1.

FIG. 7 is an exploded view of the motor and cam assembly. FIG. 7*a* is a side elevation view of an alternate two-lobe cam.

FIG. 8 is an exploded view of the override lock assembly.

DETAILED DESCRIPTION

As required, detailed embodiments of the present invention are disclosed herein. However, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Moreover, except where otherwise expressly indicated, all numerical quantities in this description and in the claims are to be understood as modified by the word "about" in describing the broader scope of this invention. Practice within the numerical limits stated is generally preferred. Also, unless expressly stated to the contrary, the description of a group or class of materials as suitable or preferred for a given purpose in connection with the invention implies that mixtures or combinations of any two or more members of the group or class may be equally suitable or preferred.

Figure 1:
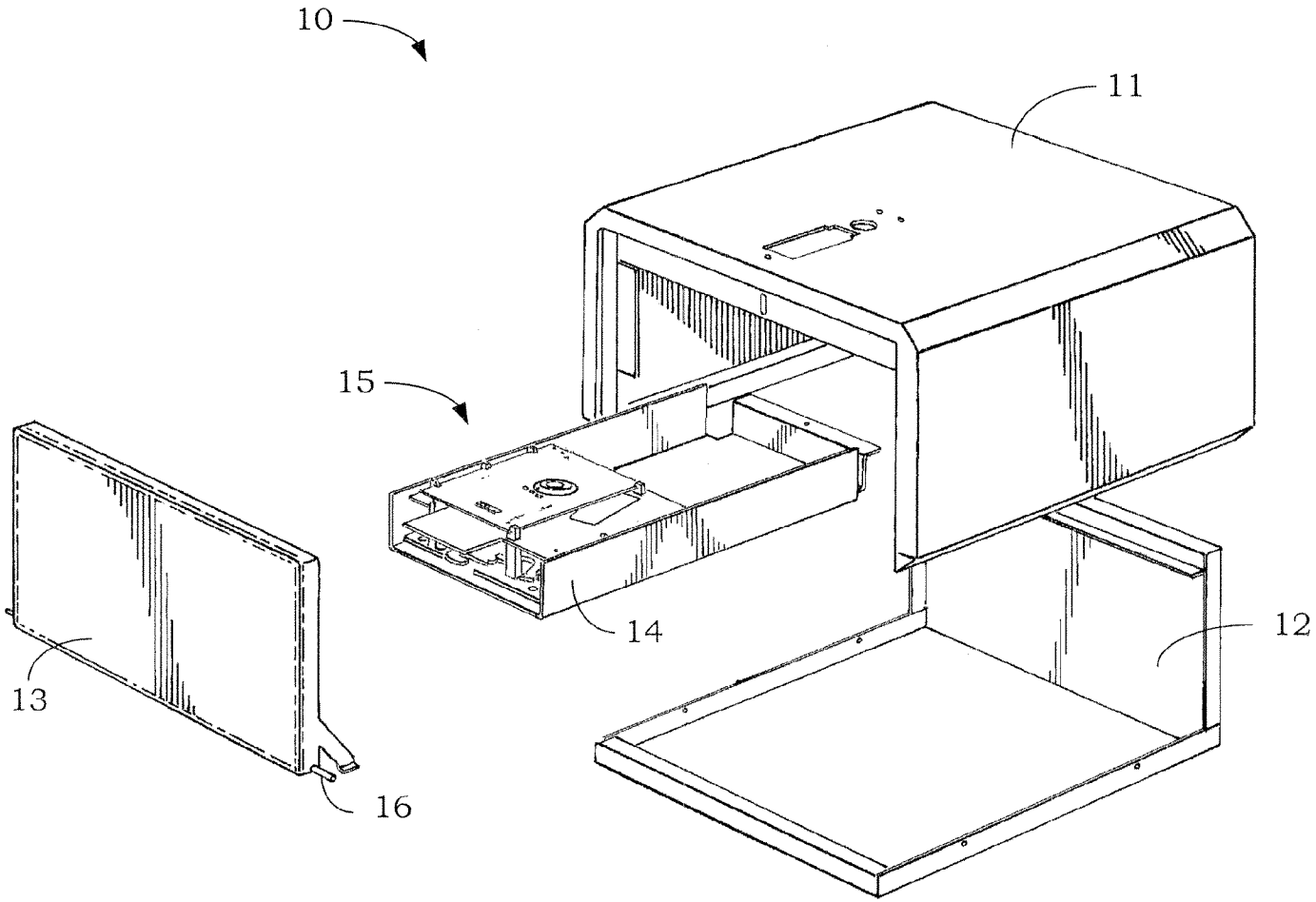
FIG. 1 is an exploded perspective view of the personal property safe of the present invention.
Figure 4:
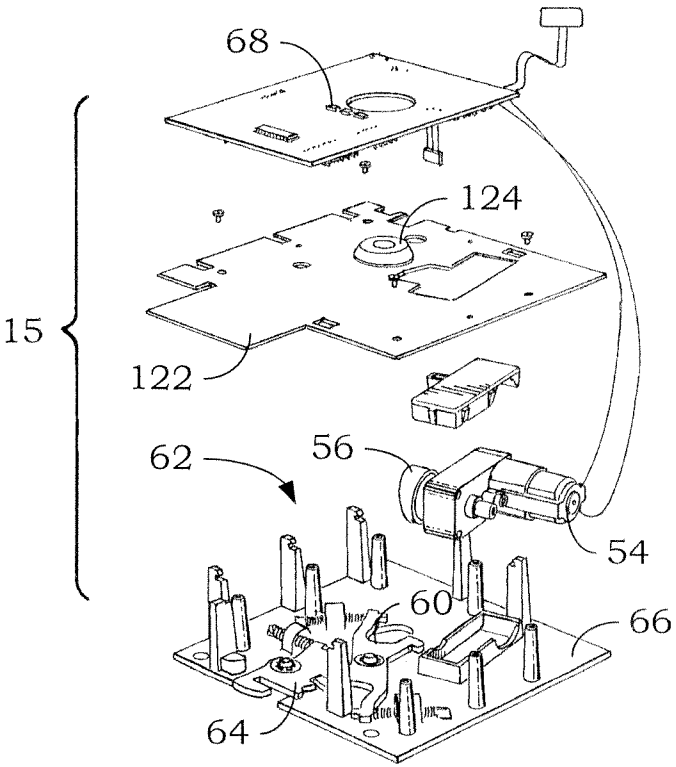
FIG. 4 is an exploded perspective view of the locking components of the personal property safe of FIG. 1.
Figure 3:
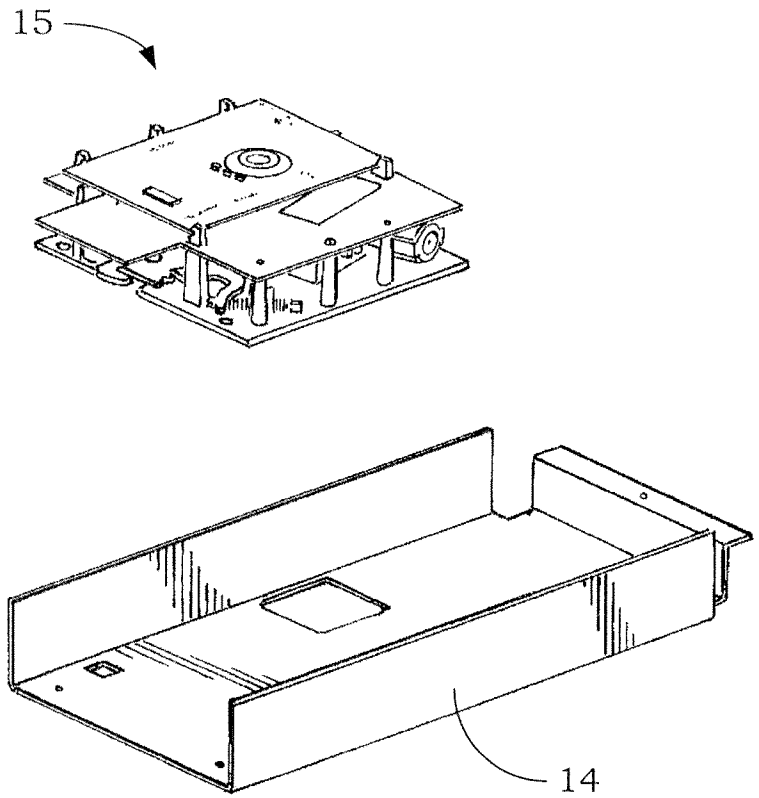
FIG. 3 is an exploded perspective view of the locking components and tray of the personal property safe of FIG. 1.

Referring initially to FIGS. 1 and 2, a personal property safe of the present invention is generally indicated by reference numeral 10. The personal property safe includes a case shell 11, a case bottom 12, a door assembly 13 and a tray 14 for mounting the electronic components, mechanical components and hardware 15 within the case 11. The door assembly 13 includes a rod hinge 16, one or more torsion springs 17, a door loop 18, and a mounting block 19 for the door loop 18.

A functional block diagram of the electronic control components of a personal property safe 10 are generally indicated by reference numeral 20. Generally, all system functions are controlled by a reduced instruction set computing ("RISC") microcontroller 22. In the preferred embodiment, the RISC microcontroller is a microchip PIC24FJ32GA004-I/PT, but one of ordinary skill in the art may choose a microcontroller appropriate for the present application. The RISC microcontroller 22 is flash based and in-circuit programmable.

The RISC microprocessor 22 is coupled to a biometric fingerprint scanner subsystem 24. The biometric subsystem 24 includes a swipe capacitive sensor 26 coupled to a processor 28, such as an AZM processor, for example. The biometric subsystem 24 may be self-contained, such as the subsystem available from UPEK. The biometric subsystem 24 performs all biometric functions, such as enrollment of fingerprints, verification of fingerprint and fingerprint data storage, for example, at the direction of the RISC microcontroller 22.

Power may be supplied to the circuit 20 through a power input circuit 30 from a 9-volt battery 32 or 12-volt DC power source 34, for example. The power sources 30 and 32 may be diode coupled, include a thermally resettable fuse to limit current draw and a transient voltage suppressor ("TVS") to protect against external electrostatic discharge ("ESD")

events. The DC power source 34 is used when active to conserve the battery 32 power. The voltage of each power source is measured by a voltage measurement circuit 36 and monitored by the RISC processor 22. The measurement circuit 36 is switched on by the RISC processor 22 only during normal operation or when the 12-volt DC power supply 34 is active to prevent the circuit from drawing the battery 32 when the system 20 is inactive.

Input from the battery 32 and power source 34 to the power input circuit 30 is controlled by an onboard MOSFET transistor which shuts off the power input circuit 30 when the system 20 is not in use to maximize the shelf life of the battery 32.

A wake up/power latching circuit 38 drives the MOSFET transistor to turn on the power input circuit 30 which in turn applies power to a main voltage regulator 40 to turn on the RISC microcontroller 22. The main voltage regulator 40 may be a linear or switching regulator. Triggering inputs to the wake up/power latching circuit 38 may include a capacitive finger sensor 42, an administration momentary switch 44, an external PC connection 46 and an external diagnostic connection 48, for example. Any of these wake up sources may turn on the RISC microcontroller 22, which may then latch the power on 38.

The capacitive finger sensor 42 is a low-power sensor that detects the proximity of a user's finger as it approaches the biometric scanner 24. In the preferred embodiment a QPROX sensor available from ATMEL Corp. is used. The capacitive finger sensor 42 outputs a signal to the wake up/power latching circuit 38 when a user's finger touches or is close to the sensor 42 to apply power to the RISC microcontroller 22 and consequently the biometric subsystem 24. The capacitive finger sensor 42 includes a dedicated 2.3 volt low-power regulator connected to the system power 32 and 34. Other methods of activating the microcontroller 22 and biometric subsystem 24 may be used, such as a pushbutton or switch, or optical sensor, for example.

The administrative button 44 is a pushbutton coupled to the wake up/power latching circuit 38 and is used to initiate the fingerprint enrollment and fingerprint database deletion functions described in detail below.

The external PC port 46 is used to communicate with the biometric subsystem 24 for diagnostic and configuration purposes. The biometric processor 28 may be programmed via the PC port 46. When a PC or other device (not shown) is connected to the PC port 46, the RISC microcontroller 22 relinquishes control of the communication bus 50 to the biometric processor 28 giving the PC control of the communication bus 50.

The diagnostic port 48 may be used to connect an external PC or other device to the RISC microcontroller 22 for configuration and debugging.

Upon receiving a triggering event, the RISC microcontroller 22 actuates a motor control circuit 52 which drives a DC motor 54. A cam 56 is mounted to a motor shaft 55, which is rotated by motor 54. As the cam 56 rotates, the lobe 58 of the cam 56 engages a primary latching arm 60 of a latching assembly 62. The position of the cam 56 is determined from the output signal from a position sensor 65. A magnet 67 is secured to the backside of the cam 56, which may be detected by the position sensor 65 as the cam 56 is rotated by the motor 54. In a home position, the lobe 58 of the cam 56 is not engaging the latching arm 60 of the latching mechanism 62. As shown, the cam 56 is rotated by the motor 54 one complete revolution each time the motor control circuit 52 receives an activation signal from the RISC microcontroller 22.

The motor control circuit 52 outputs a pulse width modulated drive signal to the motor 54 to achieve a relatively constant speed over the full supply voltage range. Pulse width modulating the drive signal compensates for varying supply voltages. When an activation signal is received from the RISC microcontroller 22, the motor control circuit 52 drives the motor 54 until a home signal is received from the position sensor 65. The motor control circuit 52 may then continue to drive the motor 54 for a predetermined overtravel so that the cam 56 will stop at the correct mechanical position. In the preferred embodiment, a cam 56 with a single lobe 58 is used with a full revolution of the motor 54 per open cycle. A multi-lobed cam 58*a* and a partial motor rotation per open cycle may be used, for example (See FIG. 7*a*).

Other sensors may be used to determine the position of the cam 56 such as optical sensors, limit switches or current sensing/measurement to the motor 54 to determine motor stalling against an end stop, for example. The motor 54 may be reversible between two home positions. A solenoid (not shown) may be used to engage the primary latching arm 60. A stepper motor may be used providing precise position control eliminating the need for a position sensor.

The latch assembly 62 includes a primary latch arm 60 and a secondary latch arm 64. The latch assembly 62 is mounted on a latch plate 66 which is mounted in a module housing 68. The primary latch arm 60 includes an aperture (not shown) to receive a pin 70, which is pressed into an aperture (not shown) in the latch plate 66. A retention clip 72 rotatably secures the primary latch arm 60 to the pin 70. The secondary latch arm 64 includes an aperture (not shown) to receive a pin 74, which his pressed into an aperture (not shown) in the latch plate 66. A retention clip 76 rotatably secures the secondary latch arm 64 to the pin 74.

The primary latch arm 60 is generally H-shaped with first and second spring arms 78 and 80 extending radially and in opposite directions from the pin 70. Standoffs 82 and 84 extend from a side of each spring arm 78 and 80. The standoffs 82 and 84 are received in one end of primary latch arm springs 86 and 88, respectively. Hooks 90 and 92 extending from the latch plate 66 are received in the opposite end of the springs 86 and 88, respectively. The springs 86 and 88 are retained in retention loops 94 and 96, respectively. The springs 86 and 88 are identical and are installed under compression so that the push arm 98 and the retaining arm 100 are always forced against the cam 56 and secondary latch arm 64, respectively. The equal force of the springs 86 and 88 applied to the primary latch arm 60 around its center of rotation prevents activation or rotation of the primary latch arm 60 by external forces such as by dropping or striking the personal property safe 10. The primary latch arm 60 may include a torsion spring (not shown) wrapped around the pin 70 and coupled to the primary latch arm 60 to rotate the primary latch arm 60. In this embodiment, the spring arms 78 and 80, standoffs 82 and 84, primary latch arm springs 86 and 88, hooks 90 and 92, and retention loops 94 and 96 could be eliminated, for example.

The secondary latch arm 64 includes a standoff 106 which is received in an end of a secondary latch arm spring 108. A hook 110 extending from the latch plate 66 is received in the opposite end of the spring 108. A retention loop 112 retains the spring 108 which when installed is compressed so that a spring force is always applied to the secondary latch arm 64. Opposite the standoff 106 is a hook 102 with a slot 104 for engaging and releasably securing the door loop 18. The secondary latch arm 64 may include a torsion spring (not shown) wrapped around the pin 74 and coupled to the secondary latch arm 64 to rotate the secondary latch arm 64. In this embodiment, the standoff 106, secondary latch arm spring 108, hook 110, and retention loop 112 could be eliminated.

Figure 5:
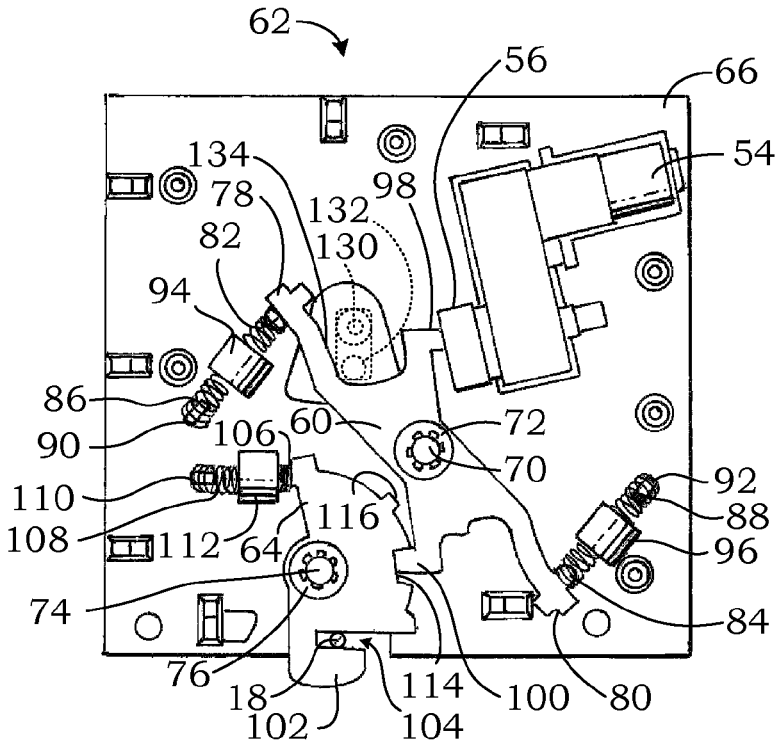
FIG. 5 is a plan view of the latching assembly and hardware components in a locked position.

The secondary latch arm 64 includes a notch 114 adapted to receive the retaining arm 100 of the primary latch arm 60. When the retaining arm 100 is engaged in the notch 114, the secondary latch arm 64 is prevented from rotating on the pin 74, as shown in FIG. 5.

When the cam 56 is rotated by the motor 54, the primary latch arm 60 rotates about pin 70 and retaining arm 100 is rotated away from secondary latch arm 64 and out of notch 114. Once the retaining arm 100 clears the lip of the notch 114, the spring 108 forces the secondary latch arm 64 to rotate about the pin 74 until a stop 116 encounters the retaining arm 100 preventing the secondary latch arm 64 from further rotation. When the secondary latch arm 64 is rotated as shown in FIG. 7, the door loop 18 is released, thereby unlocking the safe 10.

A keyed lock assembly 120 is mounted to a lock plate 122, which is mounted above the latch plate 66. The keyed lock assembly 120 includes an override lock 124, a lock nut 126 to secure the override lock 124 to the lock plate 122, a lock arm 128 secured to a shaft 130 of the override lock 124, and a bushing 132 secured to the lock arm 128. The override lock 124 may be used to open the safe 10 if the battery 32 goes dead or access using the biometric scanner 24 does not work, for example. Rotating the lock 124 with a key (not shown) rotates the lock arm 128 to engage the bushing 132 with an inside surface 134 of the first spring arm 78 of the primary latch arm 60. Continued rotation of the lock 124 causes the bushing 132 to push against the inside surface 134 of the first spring arm 78 and rotate the primary latch arm 60 about the pin 70 until the secondary latch arm 64 is released by the retaining arm 100.

Figure 9:
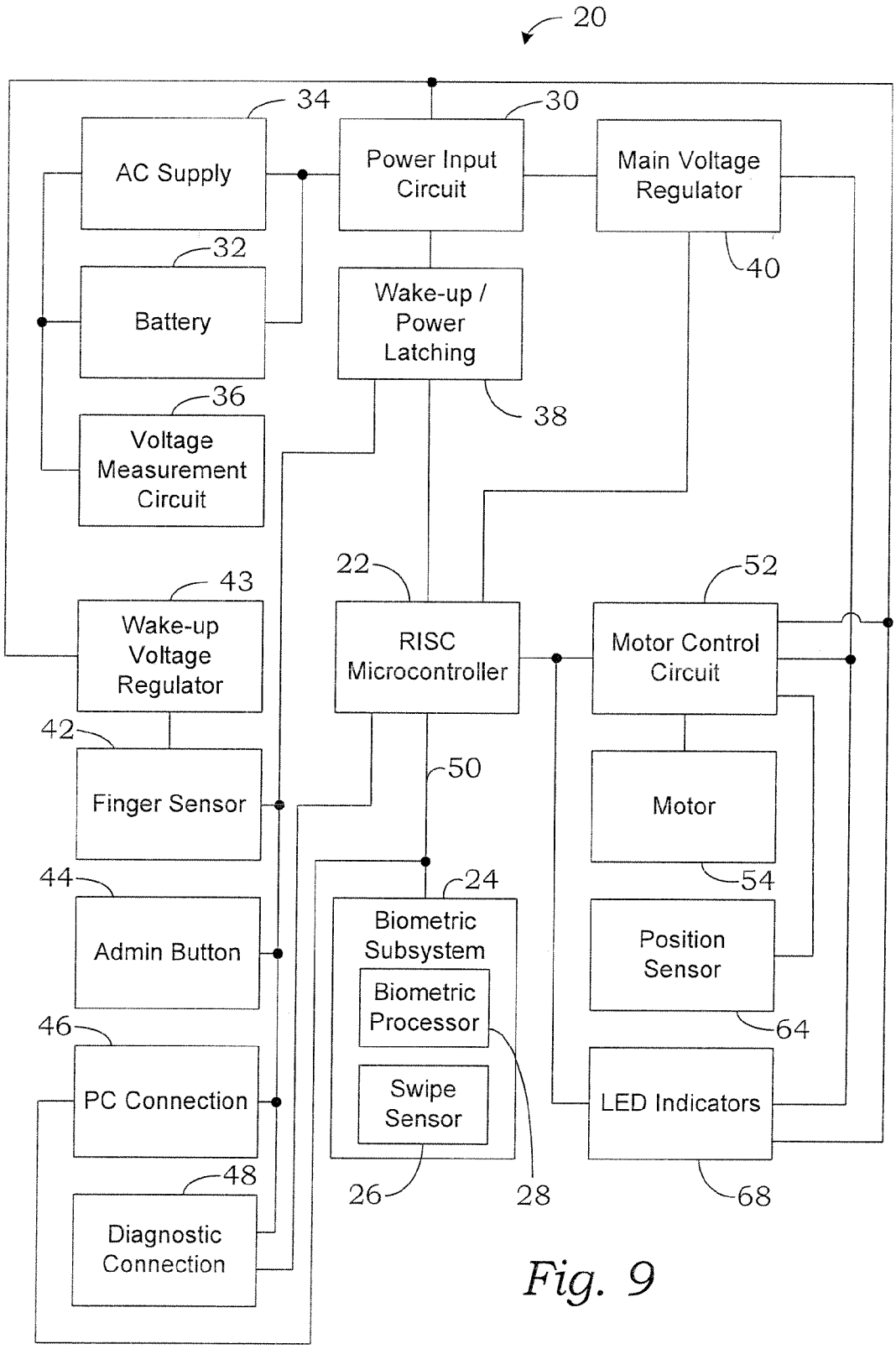
FIG. 9 is a functional block diagram of the electronic components of the personal property safe of the present invention.
Figure 10:
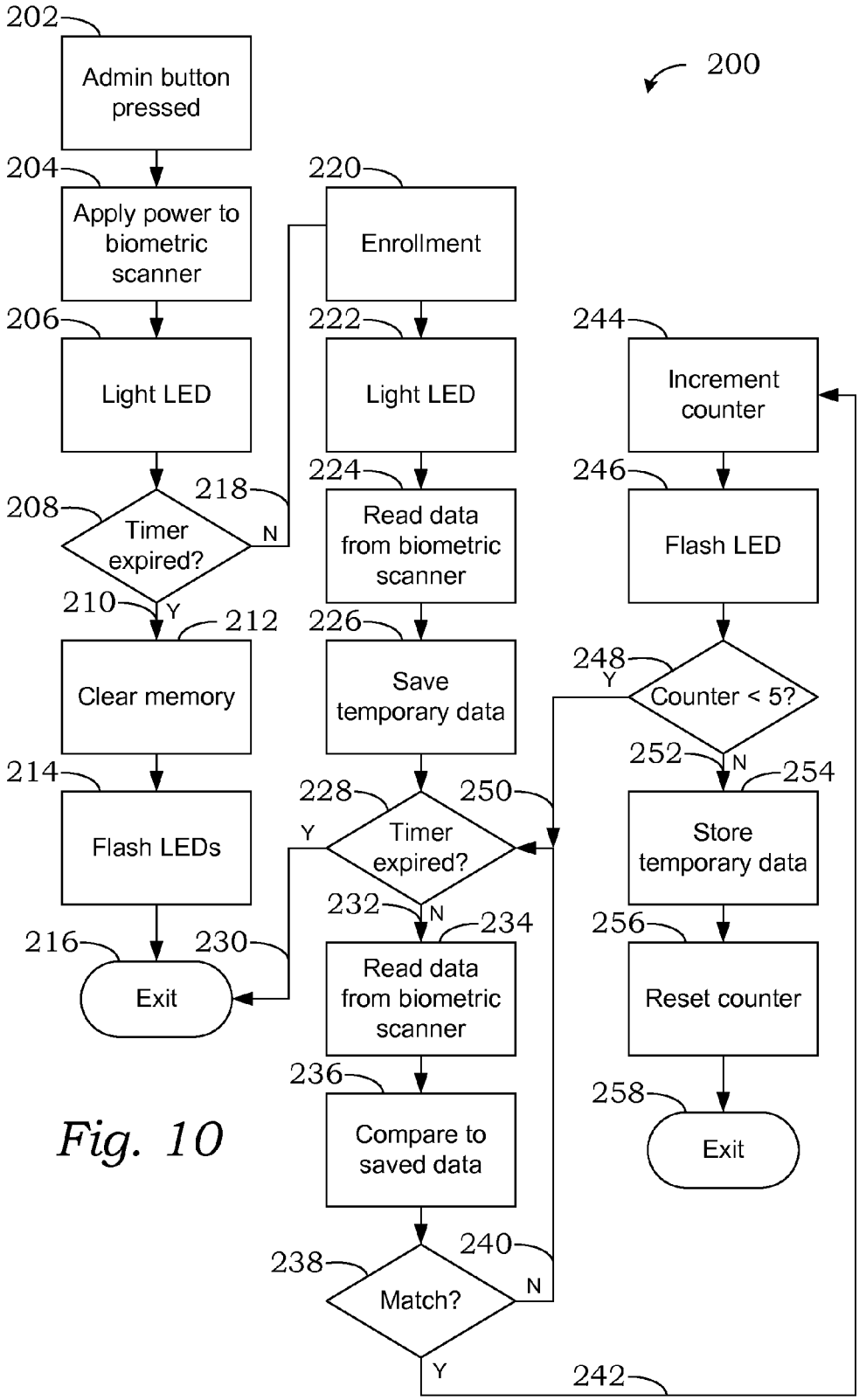
FIG. 10 is a software flow chart of the administration functions of the personal property safe of the present invention.

Referring to FIGS. 9 and 10, the admin functions are generally indicated by reference numeral 20 in FIG. 9 and the process is indicated by reference numeral 200 in FIG. 10. If the admin button 44 is pressed 202, power is applied 204 to the biometric scanner 24. An LED indicator 68 is illuminated 206 to indicate that the system 20 is on. A timer is started 208 while the admin button 44 is pressed. If the timer expires 210 while the admin button 44 is held depressed, then the internal memory is cleared 212 and the LEDs 68 are all flashed 214 to indicate to the user that the memory has been cleared. The processing exits 216 and the RISC microcontroller 22 deactivates the wake up/power latching circuit 38.

If the timer does not expire 218, indicating that the admin button 44 was pressed and released, then the system enters an enrollment mode 220. A second LED 68 is illuminated 222 to indicate that user input is requested. Data is read 224 from the biometric scanner 26 and stored 226. A timer is read to determine if it has expired 228. The purpose of the timer is to conserve energy and thus extend the battery 32 life and to not inadvertently leave the system in enrollment mode when not attended. If the timer is expired 230, processing exits 216 and the RISC microcontroller deactivates the wake up/power latching circuit 38.

If the timer has not expired 232, then data is read from the biometric scanner 234 and compared to the temporary, stored data 236 to determine if it matches 238. If the data does not match 240, then processing returns to decision block 228. If the scanned data matched the temporary stored data 242, then a counter is incremented 244, an LED 68 is flashed 246 to indicate that the scan matched. Next, the number of matches is checked 248. If the counter is less than five 250, then processing returns to decision block 228. If five matches have been scanned 252, the temporary data is stored 254, the counter is cleared 256 and processing exits 258. The enrollment process 220 may be repeated one or more times to store one or more fingerprint scans.

Figure 11:
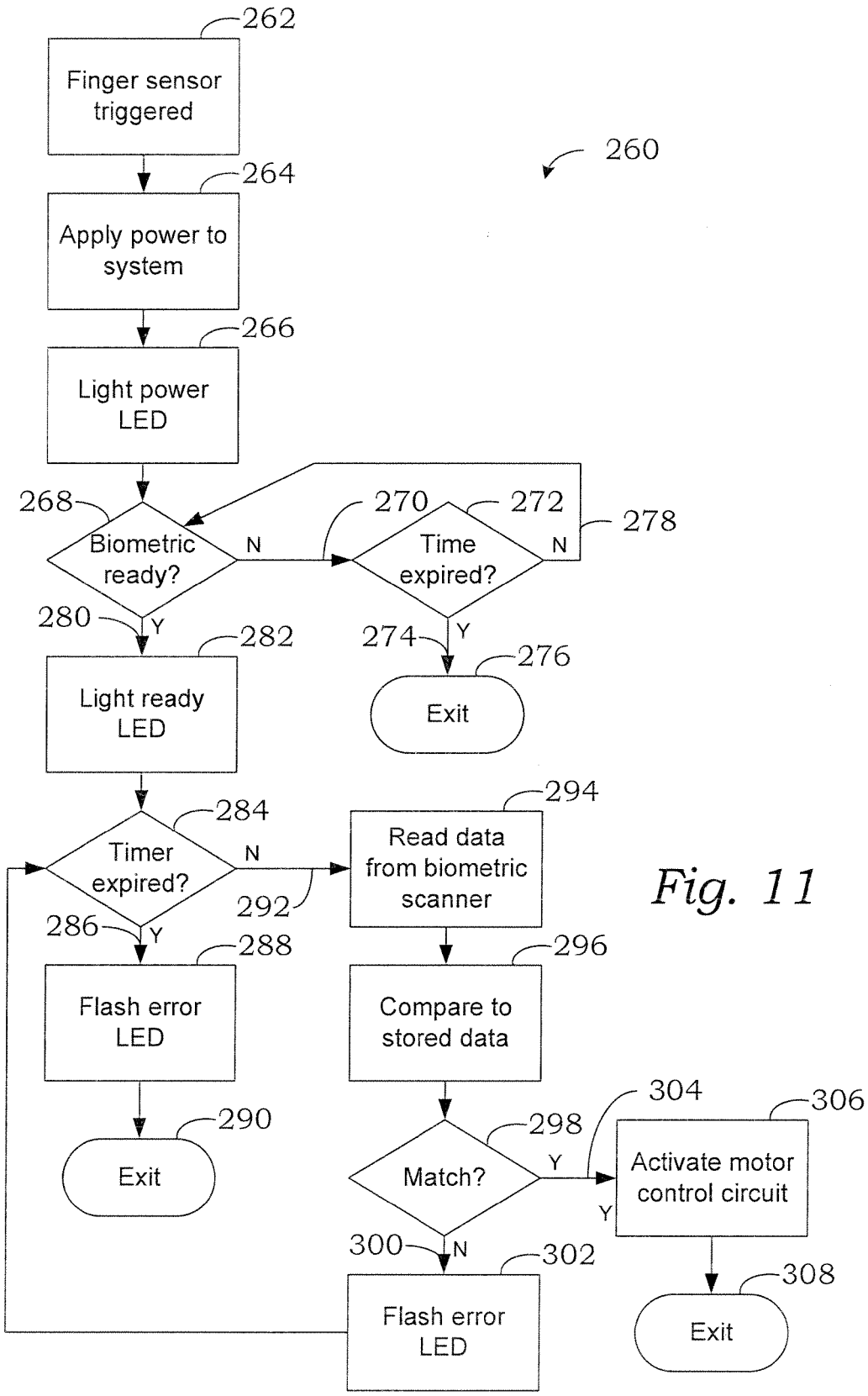
FIG. 11 is a software flow chart of the operational function of the personal property safe of the present invention.

Referring to FIGS. 9 and 11, the run function is generally indicated by reference numeral 260. If the finger sensor 42 is triggered 262, power is applied 264 to the system 20 and the power LED 68 is illuminated 266. The RISC microcontroller 22 waits for a signal from the biometric subsystem 24 to indicate that it is ready 268. If it is not ready 270, the RISC microcontroller 22 waits 272 a predetermined time 274 before deactivating the system power 278. If the biometric subsystem 24 is ready 280 a ready LED 68 is illuminated 282 and a timer started 284. If the timer expires 286, the error LED 68 is flashed and processing exits 288.

If the timer has not expired 292 data from the biometric scanner swipe sensor 26 is read 294 and compared by the biometric processor 28 to the stored data 296 for matching data 298. If the scanned data does not match any stored data 300, an LED 68, such as a red LED, is flashed 302 to indicate an error and processing returns to decision block 284. A user may scan one or more fingers one or more times before the timer expires 284 or a scan matches stored data.

If the scanned data matches a stored data 304, then a signal is sent from the biometric processor 28 to the RISC microcontroller 22 which then activates 306 the motor control circuit 52 to energize the motor 54 and processing exits 308.

In operation, the personal property safe 10 may be programmed by pressing the admin button 44. A green LED 68 may be illuminated to indicate that power has been applied to the system followed by an amber LED 68 to indicate that power has been applied to the biometric subsystem 24 and it is ready for user input. The user may then swipe his or her finger over the swipe sensor 26 to initiate the recognition sequence for programming the safe 10. If a match swipe is read a predetermined number of times, indicating a good swipe, the fingerprint scan data is stored. Two or more different fingerprint scan data files may be stored for later recognition. This permits use of different fingers to open the safe or different users to have access to the safe, for example.

Figure 6:
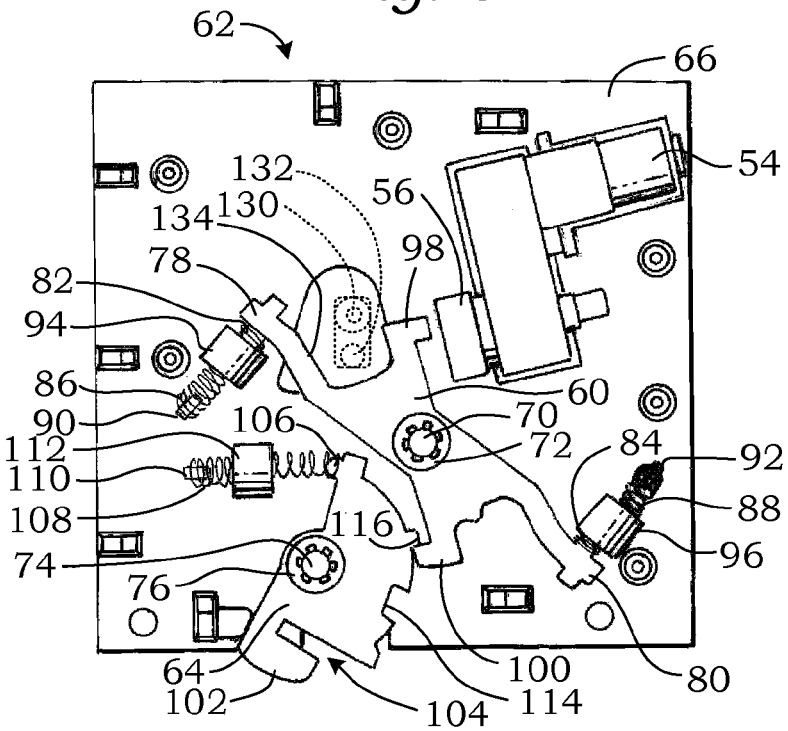
FIG. 6 is a plan view of the latching assembly and hardware components in an unlocked position.

Once the system is programmed, it is ready for use. To open the safe, a user may place his or her finger on the finger sensor 42, which triggers the wake up voltage regulator 43 to trigger the power input circuit 30 and illuminate the green LED indicator 68. The wake up/power latching circuit 38 applies power to the RISC microcontroller 22 to activate the biometric subsystem 24. When the biometric subsystem 24 is ready, an amber LED indicator 68 is illuminated and the swipe sensor 26 is active. When the user swipes his or her finger over the swipe sensor 26, biometric fingerprint scan data is read and compared to the stored scan data file(s). If a match is found, a match signal is sent from the biometric processor 28 to the RISC microcontroller 22. The RISC microcontroller 22 triggers the motor control circuit 52 which in turn energizes the motor 54. The motor 54 rotates the cam 56 which causes the primary latch arm 60 to rotate and release the secondary latch arm 64, thereby releasing the door loop 18. The hinge springs 17 force the door 13 open to provide access to the contents stored in the safe 10. To close and lock the safe 10, the door 13 is closed and the door loop 18 is forced against the retaining slot 104. The secondary latch arm 62 rotates from the released position (FIG. 6) to the locked position (FIG. 5) compressing the secondary latch arm spring 108 until the retaining arm 100 snaps back into the notch 114 and the safe 10 is again locked.

It is to be understood that while certain forms of this invention have been illustrated and described, it is not limited thereto, except in so far as such limitations are included in the following claims and allowable equivalents thereof.

The invention claimed is:

1. A safe comprising:

a case having a door, said door having a first edge and a second edge opposite said first edge, a spring loaded hinge securing said first edge of said door to said case, a door loop secured to said door proximate said second edge of said door, a latch assembly mounted within said case having a primary latch arm, a secondary latch arm, and a latch plate, said primary latch arm rotatably secured to said latch plate and having a primary axis of rotation, a first spring arm, a retaining arm, a push arm, and a second spring arm opposite said first spring arm, said secondary latch arm rotatably secured to said latch plate and having a secondary axis of rotation, a standoff, a hook with a slot adapted to releasably receive said door loop, a notch adapted to receive said retaining arm of said primary latch arm in a locked position, and a stop adapted to encounter said retaining arm and prevent further rotation of said secondary latch arm about said secondary axis of rotation in a released position, a first primary latch arm spring having a first end secured to said latch plate and a second end biased against said first spring arm of said primary latch arm thereby applying a force against said first spring arm to rotate said primary latch arm about said primary axis of rotation, a second primary latch arm spring having a first end secured to said latch plate and a second end biased against said second spring arm of said primary latch arm thereby applying a force against said second spring arm to rotate said primary latch arm about said primary axis of rotation, a secondary latch arm spring having a first end secured to said latch plate and a second end biased against said standoff of said secondary latch arm thereby applying a force against said secondary latch arm to rotate said secondary latch arm about said secondary axis of rotation from said locked position to said released position, a motor having a shaft and mounted to said latch plate, a cam having a lobe and mounted to said shaft of said motor against said push arm of said primary latch arm, a biometric scanner configured to read and store fingerprint scan data, compare read fingerprint scan data with stored fingerprint scan data and generate a match signal, a microcontroller coupled to said biometric scanner and said motor, said microcontroller responsive to receiving said match signal from said biometric scanner to activate said motor to rotate said cam, and a power supply coupled to said motor, biometric scanner, and microcontroller, whereas said lobe of said cam engages said push arm to rotate said primary latch arm about said primary axis of rotation in a direction to compress said first primary latch arm spring and said second primary latch arm spring, and rotate said retaining arm away from said notch, whereas said secondary latch arm spring rotates said secondary latch arm about said secondary axis of rotation from said locked position to said released position, whereas said door loop is released from said slot and said door springs open by said spring loaded hinge, and whereas the bias forces of said first primary latch arm spring and said second primary latch arm spring are applied to said primary latch arm around said primary axis of rotation to prevent rotation of said primary latch arm by external forces.

2. The safe of claim 1 further comprising an override lock coupled to said primary latch arm to rotate said primary latch arm about said primary axis of rotation in a direction to compress said first primary latch arm spring and rotate said retaining arm away from said notch.

3. The safe of claim 1 further comprising an indicator coupled to said microcontroller, wherein said indicator is activated by said microcontroller in response to receiving a match signal.

4. The safe of claim 1 wherein said motor is activated for one revolution in response to said microcontroller receiving a match signal.

5. The safe of claim 1 wherein said cam includes two evenly spaced lobes and wherein said motor is activated for one-half of a revolution in response to said microcontroller receiving a match signal.

6. The safe of claim 1 wherein said motor is reversible.

7. The safe of claim 1 further comprising a finger sensor coupled to a wake up circuit to activate said power supply.

8. The safe of claim 7 wherein said wake up circuit deactivates said power supply after a predetermined time period.

9. The safe of claim 1 further comprising a position sensor coupled to said cam to generate a home signal to said microcontroller when said cam is in a predetermined position.

* * * * *